United States Patent [19]

Van Dort

[11] 4,107,914

[45] Aug. 22, 1978

[54] METHOD OF MANUFACTURING TWISTLESS YARN AND YARN OBTAINED BY THIS METHOD

[75] Inventor: Jacobus Maurits Van Dort, Almelo, Netherlands

[73] Assignee: Hollandse Signaalapparaten B.V., Hengelo, Netherlands

[21] Appl. No.: 781,932

[22] Filed: Mar. 28, 1977

Related U.S. Application Data

[63] Continuation of Ser. No. 673,405, Apr. 5, 1976, abandoned.

[30] Foreign Application Priority Data

Apr. 22, 1975 [NL] Netherlands ..... 7504728

[51] Int. Cl.[2] ..... D02G 3/40; D02G 3/04

[52] U.S. Cl. ..... 57/164; 57/140 BY; 156/148; 156/166; 428/361

[58] Field of Search ..... 57/140 C, 140 BY, 162, 57/164; 28/75 R, 76 R, 167, 169; 156/148, 166, 167, 180; 428/357, 360, 361, 375, 378, 392–396

[56] References Cited

U.S. PATENT DOCUMENTS 3,877,214 4/1975 Van der Werf ..... 57/164

FOREIGN PATENT DOCUMENTS 144,679 4/1974 Netherlands ..... 57/164

1,362,615 8/1974 United Kingdom ..... 57/164

*Primary Examiner*—Richard C. Queisser

*Assistant Examiner*—Charles Gorenstein

*Attorney, Agent, or Firm*—Frank R. Trifari; David R. Treacy

[57] ABSTRACT

In a method for the manufacture of twistless or substantially twistless yarn a sliver or a roving of staple fibres is used as basic material. The sliver or the roving is wetted by a liquid mixture containing a latent solvent for at least a portion of the staple fibre material and drafted in a wet condition to form a thinner fibre strand, which is subsequently false twisted and bonded. The fibre strand is bonded by activation of the latent solvent under an increased temperature, and dried under evaporation of the solvent.

7 Claims, No Drawings

METHOD OF MANUFACTURING TWISTLESS YARN AND YARN OBTAINED BY THIS METHOD

This is a continuation of application Ser. No. 673,405, filed Apr. 5, 1976, now abandoned.

The invention relates to a method for the manufacture of twistless or substantially twistless yarn from a sliver or roving consisting of staple fibre material and to the yarn obtained by this method. The sliver or roving is thereto wetted and drafted in a wet condition to form a thinner fibre strand, which is subsequently false twisted and bonded.

Such a method is known from U.S. Pat. Nos. 3,447,310 and 3,877,214 and from the Dutch Pat. No. 144,679. In U.S. Pat. No. 3,447,310 the fibre strand is bonded by adding an inactive adhesive suspension to the staple fibre material before or during the drafing in a wet condition. After false twisting and winding, the fibre strand is bonded by activating the adhesive suspension and drying the fibre strand. The U.S. Pat. No. 3,877,214 describes an improvement to this method by the addition of a potentially adhesive staple fibre component, such as unstabilised polyvinyl alcohol, in the sliver or the roving; after false twisting and winding the fibre strand is bonded by activating the potentially adhesive component and drying the fibre strand. In the Dutch Pat. No. 144,679 the bonding occurs before the winding into a package in order to prevent migration of the adhesive in the fibre strand during the bonding process; the false-twisted fibre strand is thereto brought in direct contact with a heated surface, on which at least the completion of the activation and the drying is realised.

The potentially adhesive staple fibre component referred to in the above-mentioned patent specifications has, insofar it is soluble in water, such as unstabilised polyvinyl alcohol, or in an organic liquid, such as di- and tri-acetate, the important property that it may be removed from woven or knitted fabrics made of twistless yarns. For the potentially adhesive staple fibre componet is not added for the purpose of influencing these woven or knitted fabrics, but is added in such a minimum quantity, in practice 5—10%, that a yarn of sufficient strength for further processing is obtained.

It is an object of the present invention to provide a method as set forth in the opening paragraph, realising a bonding of the fibre strand without the addition of an adhesive suspension or a potentially adhesive staple fibre component.

According to the invention a stable fibre sliver or the roving is wetted by a liquid mixture comprising a latent solvent for at least a portion of the staple fibre material, while the fibre strand is bonded by activating the latent solvent under an increased temperature and is dried by evaporation of the solvent. The activated solvent is to dissolve only such a surface layer of at least a portion of the staple fibre material, that the fibres are bonded together at their points of contacts when dried.

The property that certain types of fibres are soluble in specific organic liquids is by itself known from the British Pat. Nos. 993,498 and 1,362,615 and the U.S. Pat. No. 3,734,799, finding its application in the non-woven production and the finishing of textile products.

Although here the staple fibre material, at any rate a portion thereof, is given binding properties through the latent solvent, it does not suggest to be potentially adhesive staple fibre material, since the potential adhesive of the prior art is added in minimum quantity and purely be reason of its adhesive properties in a sliver or roving. The percentage of soluble staple fibre material in the sliver or the roving of the instant invention will nevertheless be — if not 100% — so large (a common figure is 50% with a minimum of 20%), that its properties are substantial for the twistless yarn as final product, and it should not be possible to remove the soluble staple fibre material from woven or knitted fabrics made of this yarn: that is, the material is stable.

Various aspects of the method according to the invention will be considered hereinafter.

As basic material, either a sliver or a roving may be used. A sliver here denotes a bundle of parallel fibres and a roving a drafted and twisted sliver. Although a roving is thus twisted a substantially twistless yarn may be obtained therefrom, since after the drafting of the roving a bundle of parallel fibres is again obtained, vis. a thinner fibre strand. Using either a roving or a sliver and a draw frame, a fibre strand of the desired thickness can be obtained, forming after bonding the twistless yarn.

The drafting of the sliver or the roving to form a thinner fibre strand occurs in a wet condition. The advantages of drafting in a wet condition are described in detail in the U.S. Pat. No. 3,447,310. The liquid used to wet the sliver or the roving contains a latent solvent for at least a portion of the staple fibre material. The British Pat. Nos. 993,498 and 1,362,615, as well as the U.S. Pat. No. 3,734,799, refer to specific solvents for certain types of fibres. Thus polyacrylonitrile, modified polyacrylonitrile, cellulose diacetate and cellulose triacetate fibres, as well as chlorofibres, are soluble in sulpholane or in a blend of sulpholane and a suitable organic diluent. The term "sulpholane" represents here unsubstituted sulpholane (tetramethylene sulphone) and substituted sulpholane, such as 2-methyl sulpholane, 3-butyl sulpholane, 3-isopropyl sulpholane, 3-n-hexyl sulpholane, 2-methyl-4-butyl sulpholane and 3-cyclohexyl sulpholane. Suitable organic diluents are for example diethylene glycol, triethylene glycol, dibutyl phthalate, triethanolamine, 3-ootyl sulpholanyl ether, trichloropropyl phosphate, alcohol alkoxylate and glycol alkoxylate. The liquid used to wet the sliver or the roving may, with the application of sulpholane, consist of water, sulpholane and, if required, an organic diluent, while further plasticisers, corrosion inhibitors, fire-proofing agents, antistatic agents and dyes may be added. Also polyester and polyamide fibres appear to be soluble in chlorinated diphenyl ether, preferably 2-hydroxy-4,2',4'-trichlorodiphenyl ether. Since this substance is not soluble in water, the liquid used to wet the sliver or the roving should, apart from the latent solvent, comprise a suitable organic diluent, such as industrial methylated spirit, sulpholane, monoethylene glycol, carbon tetrachloride, trichloroethylene and tetrachloroethylene.

The sliver or the roving may consist of pure staple fibre material, a blend of different staple fibres or multicomponent fibres; it will be clear that in all cases staple fibre material, which is soluble in a specific liquid, should be present. Thus the staple fibre material may consist of 100% polyacrylonitrile, or a blend of wool, polyester or cotton with polyacrylonitrile. As already stated, the drawing liquid should contain a latent solvent for at least a portion of the staple fibre material. The expression "for at least a portion" does not exclusively refer to the case that a blend of several types of staple fibres is used, but also to the case that indeed pure staple fibre material is used, though the fibres need be dissolved only partially, mainly at the surface, as this is adequate for the bonding between the fibres.

After drafting of the sliver or the roving in a wet condition to form a thinner fibre strand, this strand is false twisted, using for example the false twisting unit referred to in the U.S. Pat. No. 3,477,310.

The fibre strand is finally bonded by bringing it in direct contact with a heated surface, e.g. a drum. Although this procedure is known from the Dutch Pat. No. 144,679, the process, according to the invention, on the drum surface is completely different. As described in the above patent, the potentially adhesive staple fibre material is activated on the drum surface, at any rate the activation thereof is completed, and the resulting fibre strand is dried. By the method here described the process on the drum surface is carried out in the following steps:

1. the liquid mixture is removed from the fibre strand, with the exception of the latent solvent and any chemical substances applied to the yarn (plasticisers, corrosion inhibitors, fire-proofing agents, dyes, antistatic agents);
2. the latent solvent is activated;
3. the solvent is evaporated from the fibre strand.

This sequence of steps is realisable only if the latent solvent is active in a temperature interval lying below the melting temperature of the staple fibre material to be dissolved, but above the temperature at which the drafing liquid, bar the latent solvent, is removed.

EXAMPLES

The examples below illustrate how twistless yarn is produced from polyacrylonitrile fibres having a titre of 1.6 dtex and a staple length of 40 mm, using a latent solvent on the basis of tetramethylene sulphone, under the trade name "Bondelane A" marketed by "Shell Hederland Chemie B.V.". This solvent is active between 120° and 130° C and evaporates above 130° C.

EXAMPLE 1

A polyacrylic roving (count of 766 tex) was passed through a water bath containing a solution of 20% by volume of "Bondolane A" and 1% of a wetting agent (Serwet WH170 of "Servo Chemie" at Deldon, The Netherlands). The roving thus wetted was drafted in this condition on a 2-cylinder draw frame with a draw ratio of 25. The yarn was subsequently false twisted and brought into contact with a rotating heated drum for 7.4 seconds, the surface temperature of the drum being approximately 140° C. The dry activated yarn was then continuously wound at a speed of 200 m/min. The count of this yarn was 31 tex, the breaking strength 15.5 g/tex and the breaking elongation 12.4%.

EXAMPLE 2

A polyacrylonitrile roving (count of 362 tex) was passed through a water bath containing a solution of 20% by volume of "Bondolane A" and 1% of a wetting agent (Serwet WH170). The roving thus wetted was drafted on a 2-cylinder draw frame with a draw ratio of 25. The yarn was subsequently false twisted and brought into contact with a rotating heated drum for 4.9 seconds, the surface temperature of the drum being approximately 140° C. The dry activated yarn was then continuously wound at a speed of 300 m/min. The count of this yarn was 15 tex, the breaking strength 13.1 g/tex and the breaking elongation 9.6%.

EXAMPLE 3

A blend of roving of 776 tex, consisting of 70% cotton and 30% polyacrylonitrile, was passed through a water bath, containing a solution of 20% by volume of "Bondolane A" and 1% of a wetting agent (Serwet WH170). The roving thus wetted was drafted on a 2-cylinder draw frame with a draw ratio of 25. The yarn was subsequently false twisted and brought into contact with a heated drum for 8.2 seconds, the surface temperature of the drum being 140° C. The dry activated yarn was then continuously wound at a speed of 180 m/min. The count of this yarn was 31 tex, the breaking strength 9.1 g/tex and the breaking elongation 3.1%.

What we claim is:

1. A method of manufacturing twistless or substantially twistless yarn from a stable fibre material, including the sequential steps of:

(a) wetting a sliver or roving of said stable fibre material with a liquid mixture comprising a first portion and a second portion which is a latent solvent for at least a portion of the stable fibre material and which evaporates at a higher temperature than said first portion;
(b) drafting the sliver or roving in a wet condition to form a thinner fibre strand;
(c) false twisting the fibre strand;
(d) heating the strand to an increased temperature so as to remove at least the first portion of said liquid mixture, while leaving at least the second portion;
(e) heating the strand to a further increased temperature so as to activate the latent solvent; and
(f) drying the fibre strand by evaporation of the solvent.

2. A method as claimed in claim 1 wherein said mixture includes a third portion consisting of components to be left in the resulting yarn, and wherein the latent solvent becomes active in a temperature range higher than the temperature range at which the first portion is removed from the fibre strand, and below the melting temperature of the stable fibres to be dissolved.

3. A method as claimed in claim 2, wherein said heating and drying steps comprise bringing the fibre strand into direct contact with a heated surface, whereupon in succession the first portion is removed from the fibre strand, the latent solvent is activated, and the fibre strand is then dried by evaporation of the solvent.

4. A method as claimed in claim 2 wherein said first portion consists of water and said latent solvent is miscible in water.

5. A method as claimed in claim 4 wherein the latent solvent consists of sulpholane.

6. A method as claimed in claim 2 wherein said first portion comprises water, the latent solvent consists of chlorinated diphenyl ether and the mixture further includes an organic diluent.

7. A twistless or substantially twistless yarn manufactured by the method of claim 1.

* * * * *